US007302902B2

(12) United States Patent
Stillman

(10) Patent No.: US 7,302,902 B2
(45) Date of Patent: Dec. 4, 2007

(54) INFLATABLE MOORING STATION

(76) Inventor: Robert Stillman, 275 E. Liberty St., Lancaster, PA (US) 17602

( * ) Notice: Subject to any disclaimer, the term of this patent is extended or adjusted under 35 U.S.C. 154(b) by 0 days.

(21) Appl. No.: 11/350,235

(22) Filed: Feb. 8, 2006

(65) Prior Publication Data

US 2007/0181050 A1 Aug. 9, 2007

(51) Int. Cl.
*B63B 35/44* (2006.01)

(52) U.S. Cl. ..... 114/263; 114/230.1

(58) Field of Classification Search ..... 114/230.1, 114/222, 263, 345, 44, 45, 264, 267; 405/1, 405/4, 3, 219; 441/3
See application file for complete search history.

(56) References Cited

U.S. PATENT DOCUMENTS

| | | | | |
|---|---|---|---|---|
| 3,570,256 | A * | 3/1971 | Thompson | 114/230.1 |
| 5,297,899 | A * | 3/1994 | Culley | 405/219 |
| 5,860,379 | A * | 1/1999 | Moody | 114/263 |
| 6,691,635 | B2 * | 2/2004 | Murakami et al. | 114/230.1 |
| 7,051,668 | B1 * | 5/2006 | Quinto et al. | 114/263 |

* cited by examiner

*Primary Examiner*—Lars A. Olson
(74) *Attorney, Agent, or Firm*—Schwartz Law Firm P.C.

(57) ABSTRACT

An inflatable mooring station is adapted for use with a fixed or floating platform extending over a body of water. The mooring station is attached to the platform, and designed for holding a water craft in a generally stationary position relative to the platform. The mooring station includes a buoyant, inflatable body and at least one line tie located on the inflatable body. An anchor line is attached at one end to the line tie and at its opposite end to the platform to secure the inflatable body to the platform.

17 Claims, 3 Drawing Sheets

INFLATABLE MOORING STATION

TECHNICAL FIELD AND BACKGROUND OF THE INVENTION

This invention relates to an inflatable, buoyant mooring station for water craft. The invention is readily portable and adapted for location adjacent any existing dock, pier, boat slip, pillar, pile, or other fixed or floating structure. The invention can also be anchored to the water bed using any conventional anchoring means to float by itself in a generally stationary position on the water. The invention provides one or more safe and convenient docking areas for boats without the use of or need for mooring buoys, fenders, rub rails, and other protective devices. When not in use, the invention can be quickly deflated for convenient storage.

SUMMARY OF INVENTION

Therefore, it is an object of the invention to provide an inflatable mooring station for water craft, such as jet skis and other small boats.

It is another object of the invention to provide an inflatable mooring station which can be quickly inflated and deflated using any conventional air pump.

It is another object of the invention to provide an inflatable mooring station which is resistant to abrasion, impact, and sunlight damage.

It is another object of the invention to provide an inflatable mooring station which is impervious to gasoline, oil, and salt water.

It is another object of the invention to provide an inflatable mooring station which is constructed of a relatively thick, reinforced PVC material for extra strength and extreme durability.

It is another object of the invention to provide an inflatable mooring station which can be filled to a high pressure for substantial rigidity while maintaining the PVC material's natural flexibility.

It is another object of the invention to provide an inflatable mooring station which has a slip-resistant outer covering.

It is another object of the invention to provide an inflatable mooring station which has a substantially flat top surface which facilitates walking/crawling to and from the water craft.

These and other objects of the present invention are achieved in the preferred embodiments disclosed below by providing an inflatable mooring station adapted for attachment to a fixed or floating structure. The mooring station is designed for holding a water craft in a generally stationary position on a body of water. The mooring station comprises a buoyant, inflatable body and at least one line tie located on the inflatable body. The line tie defines an anchor point for attaching one end of an anchor line to the inflatable body. An opposite end of the anchor line extends to and secures the inflatable body to the structure.

According to another preferred embodiment of the invention, the inflatable body has an elongated base and at least one elongated finger formed with the base.

Preferably, the finger extends at a substantially 90 degree angle to said base.

Preferably, the finger has at least one handle.

Preferably, the base has a substantially flat top surface.

Preferably, the base extends in a generally straight line designed to abut a generally straight side of the structure.

According to another preferred embodiment of the invention, the inflatable body has an elongated base and a plurality of spaced-apart elongated fingers formed with the base. Adjacent fingers cooperate with the base to form a three-sided docking area for receiving a water craft.

Preferably, each of the plurality of fingers extends at a substantially 90 degree angle to the base.

Preferably, the plurality of fingers are equally spaced.

According to another preferred embodiment of the invention, the inflatable body has an air inlet.

According to another preferred embodiment of the invention, the inflatable body has an air exhaust.

According to another preferred embodiment of the invention, the inflatable body has a slip-resistant canvas covering.

In another embodiment, the invention is an inflatable mooring station combined with a fixed or floating platform extending over a body of water. The inflatable mooring station is attached to the platform, and designed for holding a water craft in a generally stationary position relative to the platform. The mooring station includes a buoyant, inflatable body and at least one line tie located on the inflatable body. An anchor line is attached at one end to the line tie and at its opposite end to the platform, thereby securing the inflatable body to the platform.

According to another preferred embodiment of the invention, the inflatable body has an elongated base and a plurality of spaced-apart elongated fingers formed with the base. Adjacent fingers cooperate with the base to form a three-sided docking area for receiving a water craft.

Preferably, each of the plurality of fingers extends at a substantially 90 degree angle to the base.

Preferably, the plurality of fingers are equally spaced.

Preferably, each of the body and fingers has a substantially flat top surface.

Preferably, the base extends in a generally straight line and abuts a generally straight side of the platform.

According to another preferred embodiment of the invention, the inflatable body has an air inlet and exhaust.

According to another preferred embodiment of the invention, the inflatable body has a slip-resistant canvas covering.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
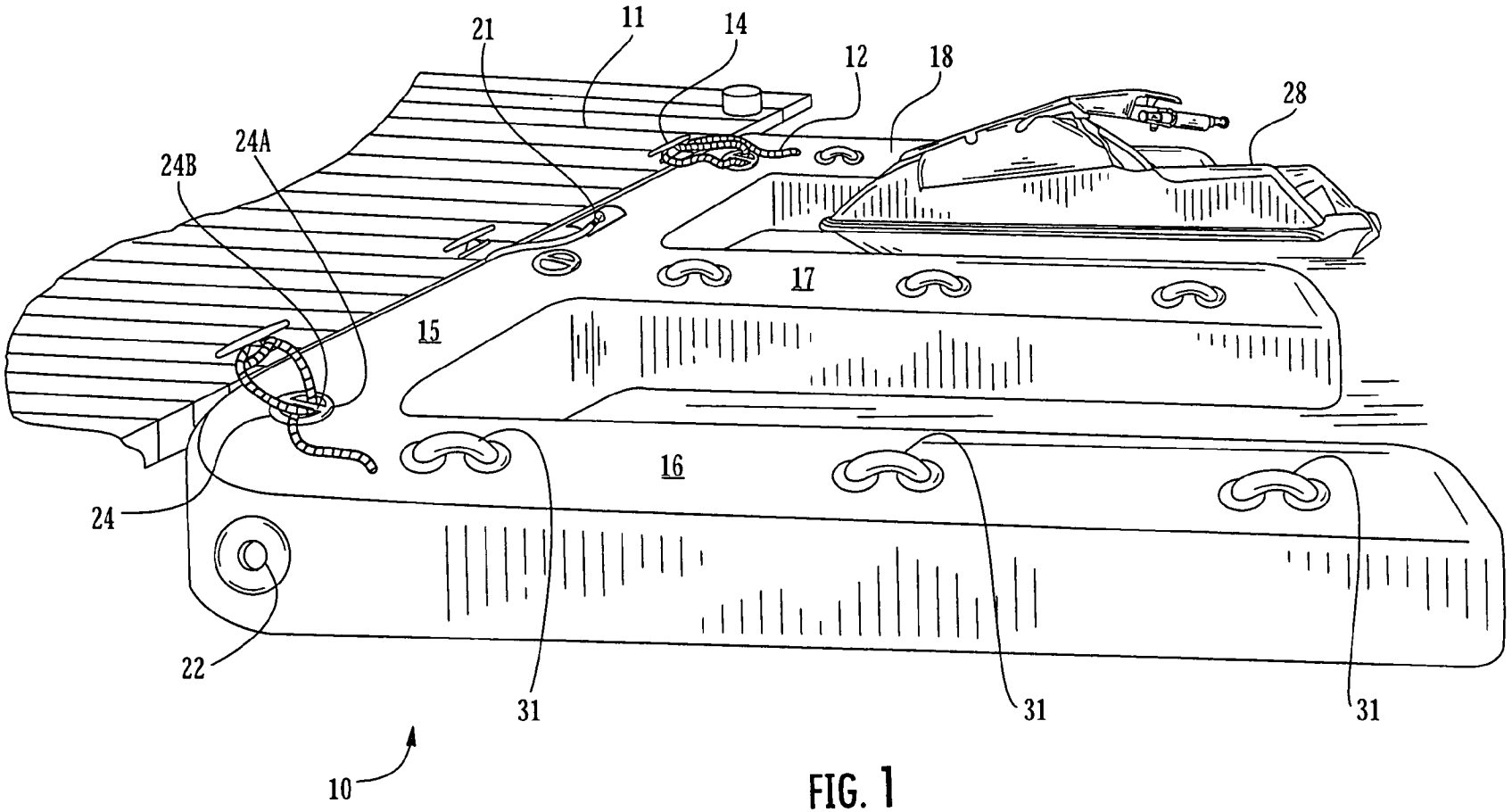
FIG. 1 is an environmental view of an inflatable mooring station according to one preferred embodiment of the present invention.

Referring now specifically to the drawings, a buoyant, inflatable mooring station according to the present invention is illustrated in FIG. 1, and shown generally at reference numeral 10. In one application, the mooring station 10 is secured directly to a conventional boat dock 11, or other fixed or floating structure, using common dock lines 12 and cleats 14. Alternatively, the mooring station 10 may be used by itself (i.e., separate from the boat dock) and tethered to a vertical pile or pillar, or any other structure extending from the water bed. In yet another application, the mooring station 10 may be held substantially stationary on the water using any conventional anchoring means.

Figure 2:
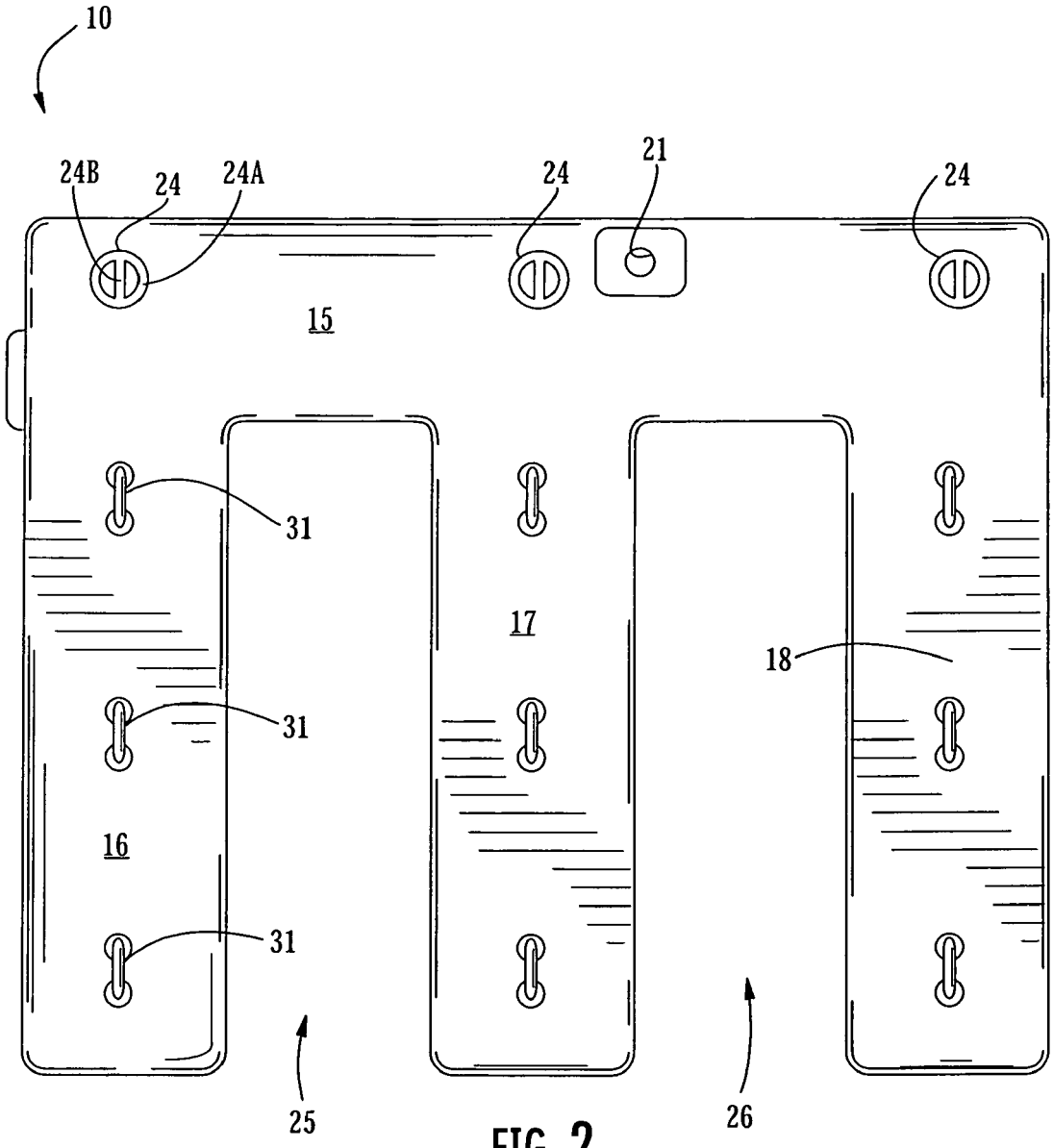
FIG. 2 is a top view of the mooring station.

As shown in FIGS. 1 and 2, the mooring station 10 comprises an elongated base 15 and preferably three equally spaced apart, outwardly-extending fingers 16, 17, and 18. Preferably, the base 15 and fingers 16-18 are integrally formed together, and define a single air chamber designed for inflation using a standard quick-fill electric pump (not shown). The air pump has a flexible hose and nozzle which connects to a one-way inlet 21 formed with the base 15 of the mooring station 10. A releasably sealed exhaust 22 allows quick deflation of the mooring station 10 for easy storage.

The base 15 of the mooring station 10 extends in a substantially straight line, and is designed to closely abut a straight side of the dock 11. Preferably, the base 15 has a number of sunken line ties 24 used to secure the dock lines 12 to the mooring station 10. Each line tie 24 comprises an integrally-molded rigid cup 24A and fixed anchor bar 24B around which the dock line 11 is tied. Alternatively, the line ties 24 may comprise fixed or pop-up cleats, rings, or other suitable structure.

The fingers 16-18 of the mooring station 10 are disposed substantially perpendicular to the base 15, and are sufficiently spaced apart to form respective three-sided docking areas 25 and 26 for receiving water craft 28, such as jet skis and other small boats. Convenient station handles 31 are located on each of the fingers 16-18 to help users move to and from the water craft 28. Additionally, the top surfaces of the base 15 and fingers 16-18 are preferably substantially flat, and collectively form a relatively stable deck for walking/crawling to and from the dock 11. The mooring station 10 preferably has a durable, puncture- and slip-resistant canvas covering.

According to one embodiment, the length of each finger 16-18 is greater than 50% of the length of the base 15. The length and width of each docking area 25, 26 defined by the base 15 and adjacent fingers 16-18 is approximately 8 ft×4 ft. The height of the mooring station 10 extending above the water is approximately 2 feet. The interior walls of the mooring station 10 preferably comprise multiple layers of heavy-gauge PVC laminated to an inner layer of polyester mesh. The heavy gage construction allows the mooring station to be filled to a point of substantial rigidity without losing the natural flexibility of the PVC material. The mooring station is preferably impervious to gasoline, oil, and salt water, and is highly resistant to abrasion, impact, and sunlight damage.

Figure 3:
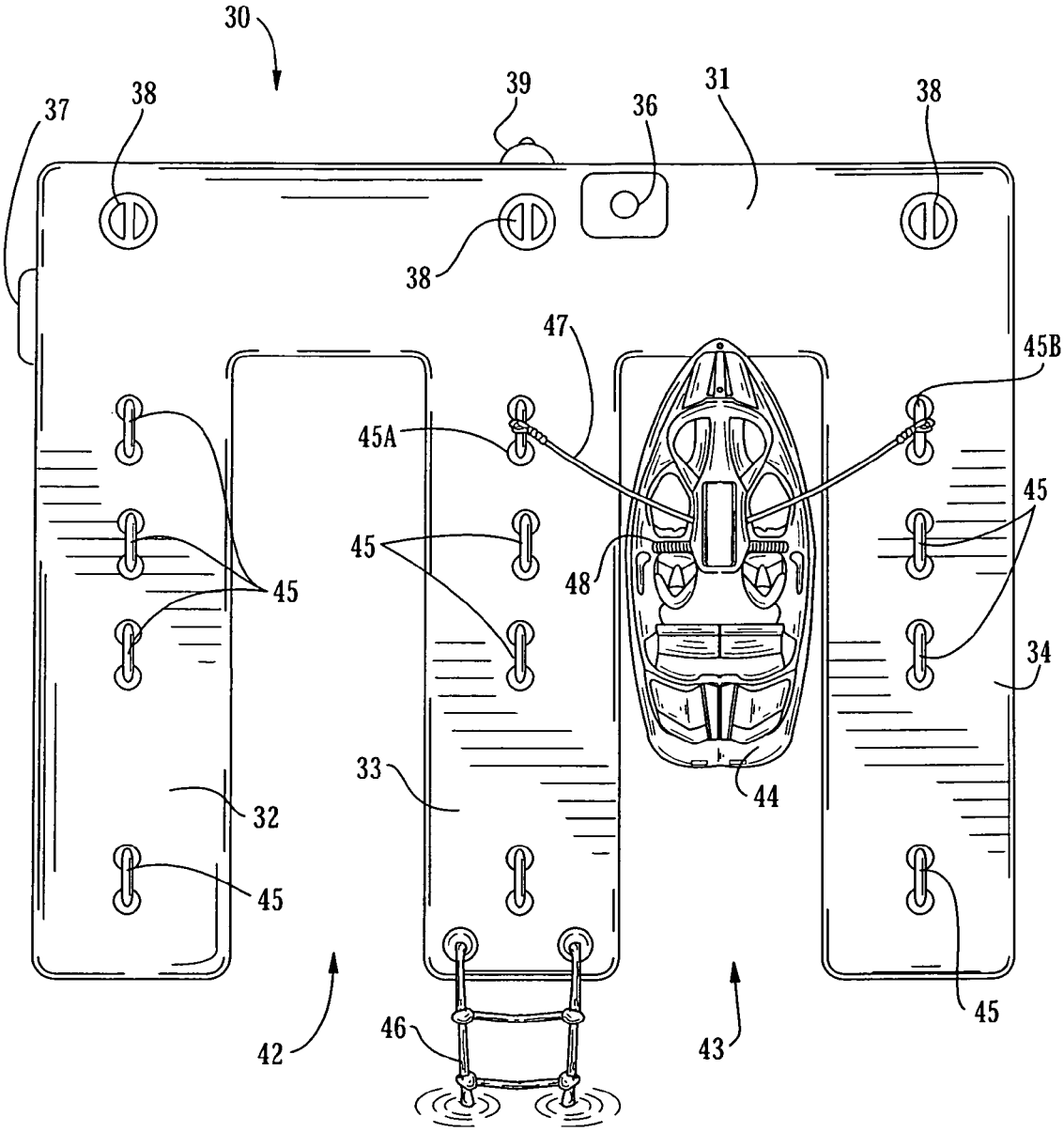
FIG. 3 is a top view of the mooring station according to a further preferred embodiment of the present invention.

FIG. 3 discloses another preferred embodiment of a mooring station 30 according to the present invention. Like mooring station 10, the mooring station 30 comprises an elongated base 31 and three equally spaced apart, outwardly-extending fingers 32, 33, and 34. The base 31 and fingers 32-34 are integrally formed together, and define a single air chamber designed for inflation using a standard quick-fill electric pump. The air pump has a flexible hose and nozzle which connects to a one-way inlet 36 formed with the base 31 of the mooring station 30. A releasably sealed exhaust 37 allows quick deflation of the mooring station 30 for easy storage.

The base 31 of the mooring station 30 has a number of sunken line ties 38 used to secure dock lines, and an anchor tie 39 located on a front wall of the base 31 for tethering the mooring station 30 to a conventional drop anchor (not shown) or other anchoring means.

The fingers 32-34 of the mooring station 30 are disposed substantially perpendicular to the base 31, and are sufficiently spaced apart to form respective three-sided docking areas 42 and 43 for receiving jet skis 44 and other small water craft. Convenient station handles 45 and rope ladder 46 are provided to help users move to and from the jet ski 44. To help retain the jet ski 44 in the docking area 43, a flexible bungee cord 47 or other elastic rope is secured to opposing station handles 45A, 45B and pulled beneath the steering handle 48 of the jet ski 44.

An inflatable mooring station is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. An inflatable mooring station adapted for attachment to a fixed or floating structure, and designed for holding a water craft in a generally stationary position on a body of water, said mooring station comprising:

a buoyant, inflatable body having a height dimension sufficient to extend said body at least two feet above a surface of the water; said body comprising an elongated base and a plurality of spaced-apart elongated fingers formed perpendicular to said base, each finger having a proximal and distal end and opposing parallel side walls extending outwardly from said base, such that adjacent fingers cooperate with said base to form a three-sided docking area including a front wall and opposing perpendicularly disposed side walls for receiving a water craft, and wherein each of said plurality of fingers has a length greater than 50% of a length of said base;

said base and said plurality of fingers having respective substantially flat top surfaces, said top surfaces collectively defining a substantially flat deck for supporting users maneuvering to and from the water craft;

at least one station handle centrally located on respective top surfaces of said plurality of fingers, and each station handle having opposite ends attached to said finger, and defining a hand opening for receiving a hand of a user;

at least one line tie located on said inflatable body, and defining an anchor point for attaching one end of an anchor line to said inflatable body, whereby an opposite end of the anchor line extends to and secures said inflatable body to the structure; and a flexible cord secured to respective station handles of adjacent fingers, and adapted for engaging and retaining the water craft in said docking area.

2. An inflatable mooring station according to claim 1, wherein said base extends in a generally straight line designed to abut a generally straight side of the structure.

3. An inflatable mooring station according to claim 1, wherein each of said plurality of fingers extends at a substantially 90 degree angle to said base.

4. An inflatable mooring station according to claim 3, wherein said plurality of fingers are equally spaced.

5. An inflatable mooring station according to claim 1, wherein said inflatable body comprises an air inlet.

6. An inflatable mooring station according to claim 1, wherein said inflatable body comprises an air exhaust.

7. An inflatable mooring station according to claim 1, wherein said inflatable body comprises a slip-resistant canvas covering.

8. An inflatable mooring station according to claim 1, and comprising a station ladder extending from a free end of one of said plurality of fingers to assist users moving to and from the top surface of said finger.

9. An inflatable mooring station according to claim 1, wherein said docking area defined by said base and fingers has a length and a width of approximately 8 feet by 4 feet.

10. In combination with a fixed or floating platform extending over a body of water, an inflatable mooring station attached to said platform, and designed for holding a water craft in a generally stationary position on the water, said mooring station comprising:

a buoyant, inflatable body; said body comprising an elongated base and a plurality of spaced-apart elongated fingers formed with said base, such that adjacent fingers cooperate with said base to form a three-sided docking area for receiving a water craft, and wherein each of said plurality of fingers has a length greater than 50% of a length of said base;

said base and said plurality of fingers having respective substantially flat top surfaces, said top surfaces collectively defining a substantially flat deck for supporting users maneuvering to and from the water craft;

at least one station handle centrally located on respective top surfaces of said plurality of fingers;

at least one line tie located on said inflatable body; and an anchor line attached at one end thereof to said line tie and at an opposite end thereof to said platform, thereby securing said inflatable body to said platform; and an above-water flexible cord secured to respective station handles of adjacent fingers, and adapted for engaging and retaining the water craft in said docking area.

11. A combination according to claim 10, wherein each of said plurality of fingers extends at a substantially 90 degree angle to said base.

12. A combination according to claim 11, wherein said plurality of fingers are equally spaced.

13. A combination according to claim 10, wherein said base extends in a generally straight line and abuts a generally straight side of said platform.

14. A combination according to claim 10, wherein said inflatable body comprises an air inlet and exhaust.

15. A combination according to claim 10, wherein said inflatable body comprises a slip-resistant canvas covering.

16. A combination according to claim 10, and comprising a station ladder extending from a free end of one of said plurality of fingers to assist users moving to and from the top surface of said finger.

17. A combination according to claim 10, wherein said docking area defined by said base and fingers has a length and a width of approximately 8 feet by 4 feet.

* * * * *